US005291380A

United States Patent [19]

Behr

[11] Patent Number: 5,291,380

[45] Date of Patent: Mar. 1, 1994

[54] LAMP

[75] Inventor: Wolfgang Behr, Lippstadt, Fed. Rep. of Germany

[73] Assignee: Wilhelm Koch GmbH, Gutersloh, Fed. Rep. of Germany

[21] Appl. No.: 929,417

[22] Filed: Aug. 14, 1992

[30] Foreign Application Priority Data

Aug. 17, 1991 [DE] Fed. Rep. of Germany ..... 9110182
Jun. 12, 1992 [DE] Fed. Rep. of Germany ..... 9207949

[51] Int. Cl.[5] ..... F21V 7/02

[52] U.S. Cl. ..... 362/310; 362/226; 362/267; 313/113; 313/318

[58] Field of Search ..... 362/310, 226, 455, 267, 362/351; 313/113, 318

[56] References Cited

U.S. PATENT DOCUMENTS

| | | | |
|---|---|---|---|
| 250,227 | 11/1881 | Fox | 313/113 |
| 299,277 | 5/1884 | Sheridan | 313/113 |
| 1,962,106 | 6/1934 | Thompson | 313/318 |
| 2,182,904 | 12/1939 | Rover | 313/113 |
| 2,278,545 | 4/1942 | Gravenstine | 362/310 |
| 2,444,915 | 7/1948 | Cade | 313/318 |
| 2,633,548 | 3/1953 | Kramel | 313/113 |
| 3,274,420 | 9/1966 | Akira et al. | 313/318 |
| 3,626,173 | 12/1971 | Harvey | 362/351 |
| 3,721,850 | 3/1973 | Giller | 362/351 |
| 4,310,772 | 1/1982 | Tyler et al. | 313/318 |
| 4,535,397 | 8/1985 | May | 362/310 |
| 4,868,722 | 9/1989 | Haraden | 362/310 |

*Primary Examiner*—Richard R. Cole
*Assistant Examiner*—Alan B. Cariaso
*Attorney, Agent, or Firm*—Banner, Birch, McKie & Beckett

[57] ABSTRACT

The invention concerns a lamp having a reflector, a glass lid and a filament which is supported by supply wires. The supply wires pass from the interior of the lamp to the outside through the connecting area between the reflector and the glass lid. The reflector is thus almost 100 percent effective because there is no space required for a material collection marking a passage of supply wires or a socket for receiving a bulb. The light performance of the lamp is thus an optimum.

16 Claims, 2 Drawing Sheets

Figure 1:
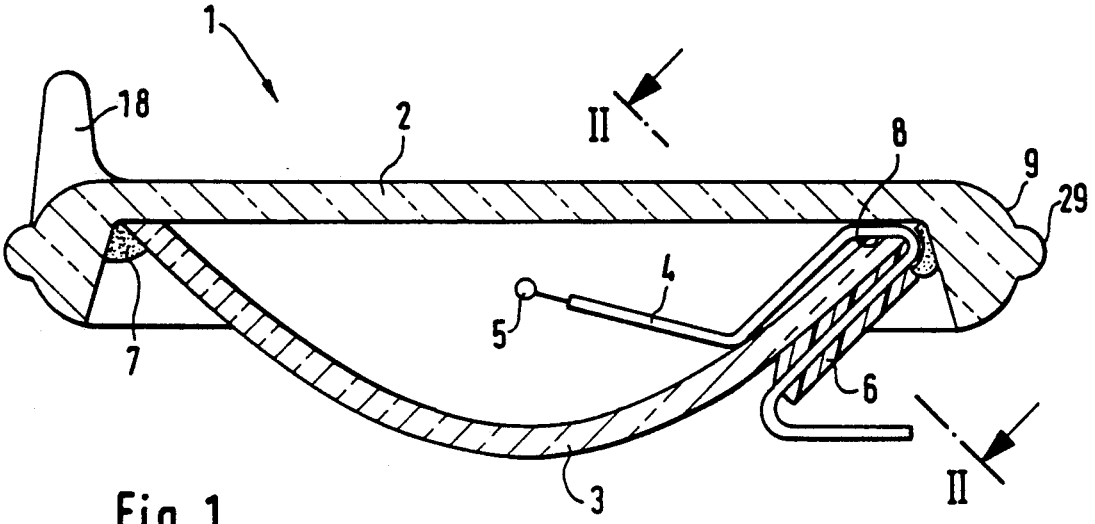

Fig. 4
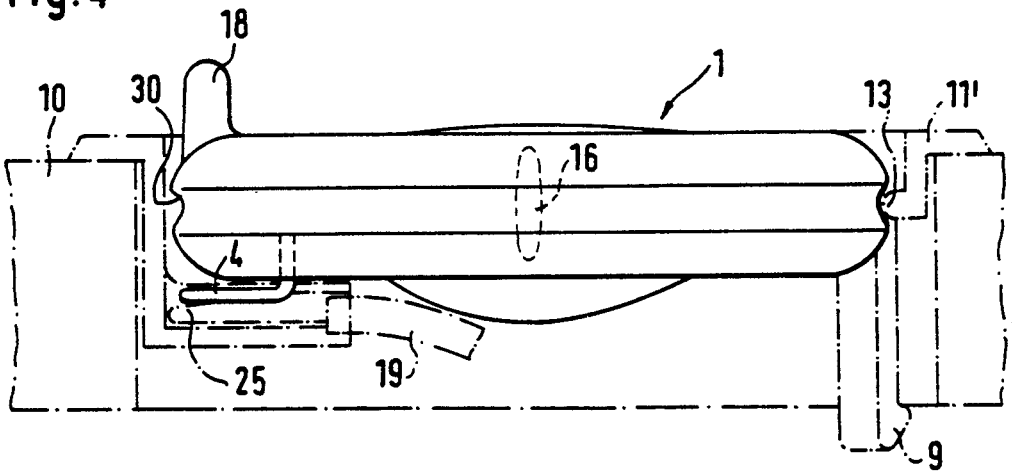
Fig. 5
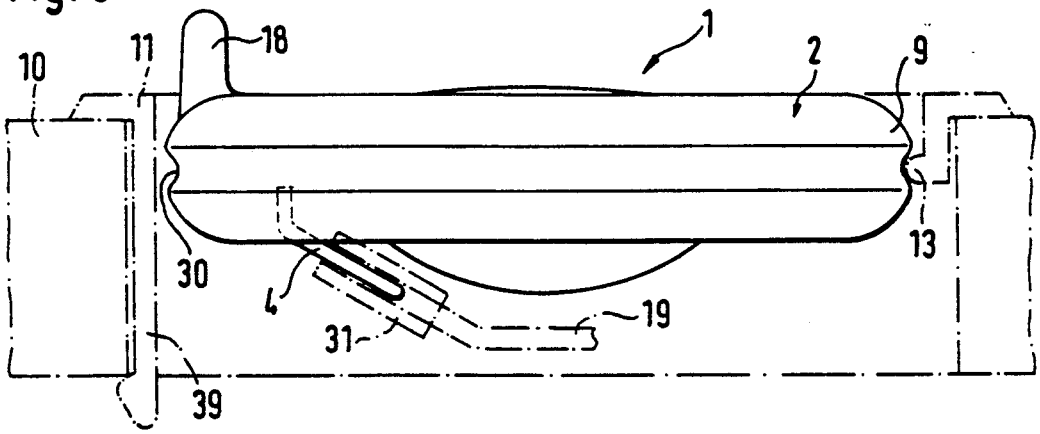
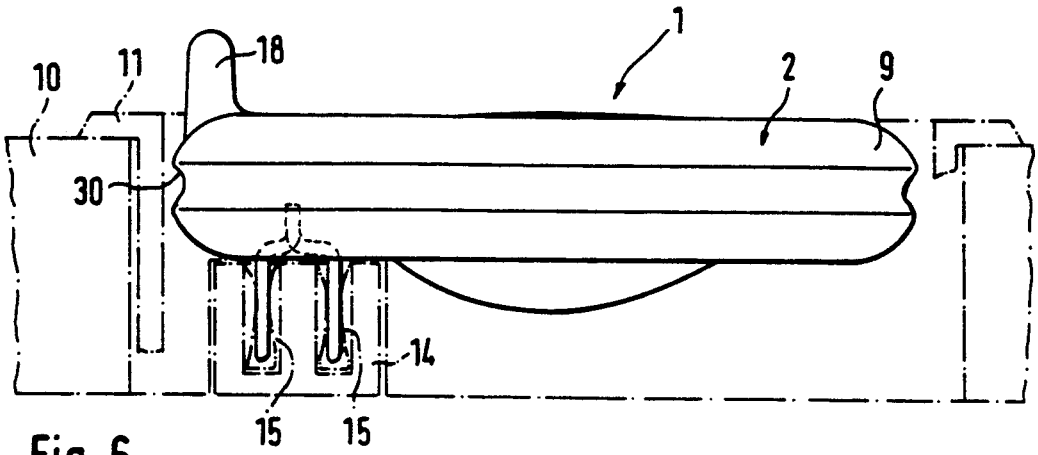
Fig. 6

LAMP

The invention concerns a lamp for use in roofed or closed rooms comprising a reflector and a glass lid as well as a filament supported between two supply leads which are extending from the gas filled interior of the lamp to the outside.

Similar lamps are commonly used for interior design, for furniture and built-in-furniture as fixtures. In addition to the use in roofed or closed rooms, as mentioned above, such lamps can also be used in carports, and in gardens and the like as long as there is a closed room around the lamp which may be encapsuled within a corresponding light structure.

The smaller the lamps according to the invention are designed, the more important is the efficient use of the reflector surface, because with sockets, when bulbs are used, or with material collections for the penetration of the supply wires through the bulb body into the interior of the lamp, there is a certain requirement of space which can hardly be lowered. If now by miniaturization the reflector surface decreases, then the percentage of the useable reflector surface compared to the total surface will also drop sharply due to the constant surface requirements for sockets and/or the passages for the lead-in wires.

It is an object of the invention to further develop a lamp of the initially mentioned kind in which despite miniaturization, the majority of the reflector is useable as a reflector surface. Independent from miniaturization, it is also an object of the invention to achieve an optimum as to the largest useable reflection surface on common reflectors.

To meet this object the invention proposes that the reflector and the glass lid are glued, melted or sealed together and that each supply wire crosses the gluing, melting or sealing connection.

The invention proposes for the first time to guide the supply wires or electrodes through the sealant, glue, cement, melt or seal zone into the interior of the lamp which is necessarily formed if the reflector and glass lid are connected to each other. The invention is thus limited to this two part design having a separate reflector and glass lid. Not only metallic reflectors but also coated glass reflectors may be used. With the latter it is unimportant whether the mirror surface is provided on the inside or on the outside of the reflector. In the latter case the reflector is commonly protected by a layer of lacquer or other protective coat. The lid is always made from glass in a preferred embodiment because of the reliability as to light permeability in connection with the high temperature resistance necessary, for instance, with halogen lamps.

Due to the passage of the supply wires through the glue, melt or sealing section no material concentration, block or the like within the area of the reflector is necessary in order to direct the supply wires or the electrodes into the interior of the lamp. In this way almost the entire reflector surface can be used solely for reflection and the only loss zones are the shadows of the supply wires. Thus, almost a hundred percent use of the reflector is possible for reflection. As a consequence there is a higher yield of light and thus an improvement as to the light performance of the lamp.

For facilitating the assembly of a lamp according to the invention, especially for the protection of the filament installed between the supply wires, it is preferable to support the supply wires outside of the interior of the lamp one against the other by a connecting element which is electrically isolating. In this way there is a unit consisting of the filament, the supply wires and the connecting element which can be easily handled manually or by robots. The stability of the connecting element makes sure that the supply wires keep their preset distance in the section where the filament is attached so that the latter cannot be destroyed.

For the further facilitation of the assembly, and for shortening the free length of the supply wires from the last support point on the interior side of the reflector to the filament, each supply wire is formed like a clip around the reflector on both sides of the passage through the glue, melt or seal connection.

The sealant, glue, cement or paste used to form a gas-tight connection between the main components, namely the reflector and the glass lid, must be chosen to have a coefficient of expansion matching that of the supply wires. The same is true for the case when the reflector and the lid are both made of glass and are molten together around their contact zone for closing the lamp. If matching materials are not used, the sealing material must have a residual elasticity for compensating for different expansions. Further, each supply wire can be formed in the section of the passage through the sealing or gluing connection in the shape of a screw, a loop or a zigzag line. Additionally, or alternatively, the cross section at this particular place can be weakened so that, when the sealing material is not elastic, the supply wire suffers a plastic deformation during temperature variations and the heat expansions going with it. There is enough room around the reflector rim to use a multitude of thin supply wires instead of one single supply wire, each of which suffers a plastic deformation during temperature variations.

A lamp according to the invention is, when assembled, a unitary structure formed by the glass lid, the reflector and the filament including the supply wires and possibly the connecting element between the supply wires. The lamp can be snapped, squeezed or inserted into a housing and secured within the housing by an open ring spring such as used on shafts. The free ends of the supply wires may form contact pins which can be plugged into a socket so that, by inserting the lamp into a certain receiving part, the electrical contact is already made. The receiving body may also have, for instance, resilient contact tongues or the wall panel into which the lamp may be inserted may have a contact rail which crosses the opening for receiving the lamp. The free ends of the supply wires will contact the correct tongues or contact rails when positioned in a preset orientation into the respective opening. Of course, the free ends of the supply wires may have a predetermined distance to each other and be arranged parallel to each other so that a standardized plug, which is connected with a lead from a transformer, can be pushed over them.

It is especially easy to create the reflector in that a glass body of the wanted form is mirrored on its outside and covered by a protective cover or layer. In this way powerful paraboloid mirrors can be produced in a very simple way and at low costs. By arranging the filament in the focus, before the focus, or behind the focus the direction of the light emitted can be adjusted from parallel to spread. Of course, the reflector can be a stepped reflector if a big light emitting surface is requested.

Figure 2:
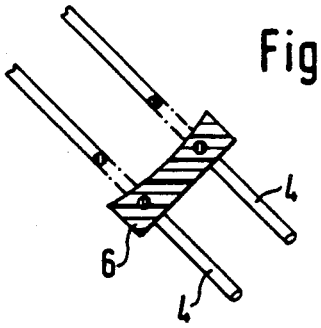
Figure 3:
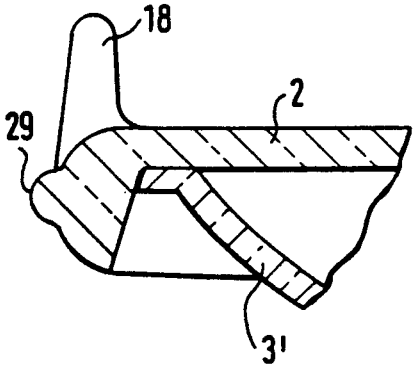

Hereinafter embodiments of the invention which are shown in the drawings are explained in greater detail. In the drawing:

FIG. 1 is a cross-sectional view through a lamp according to the invention,

FIG. 2 is a cross-sectional view along the line II—II in FIG. 1, the reflector being deleted, FIG. 3 is a cross-sectional view of a section of FIG. 1 according to further embodiments, FIG. 4 is a diagramatical cross-sectional view through a further embodiment of the lamp of FIG. 1 with a frame provided for the installation into a plate, FIG. 5 is a cross-sectional view according to a further embodiment of FIG. 4, and FIG. 6 is a cross-sectional view according to a further embodiment of FIG. 4, with automatic contacting of the electrical supply system during the installation of the lamp into its frame.

The lamp 1 shown in FIG. 1 consists substantially of a glass lid 2 and a reflector 3. Both parts are connected along the respective edge sections with the aid of a sealant 7 which also provides a gas-tight seal. Passing through the glue or sealing section are two supply wires or leads 4 which are kept spaced at a distance to each other and which carry at their inner ends a filament 5. The outer, free ends of the supply wires 4 form contact pins for plugs, sockets, solder connections and the like.

The two supply wires 4 and the filament 5 form a separate unit with the aid of a plate-like connecting element 6. The whole unit is so formed that it rides on the rim of the reflector 3 like a clip and passes through the glue or seal section, i.e. through the sealant 7. The form of the platelike connecting element 6 can be seen from FIGS. 1 and 2.

During the assembly of a lamp according to the invention shown in FIGS. 1 to 3, first the reflector 3 is made from glass to be a paraboloid, then this glass reflector receives a mirrorsurface on the outside which is covered by a protective layer, for instance by a lacquer. Then the connecting unit shown in FIG. 2 is placed over the rim of the reflector 3 at any place around the circumference where the reflector carries a recess 8 for receiving the supply wires 4. The supply wires 4 are so formed that the filament 5 is positioned exactly in the focus of the paraboloid of the reflector 3 when the connecting unit shown in FIG. 2 is correctly placed onto the reflector rim. In the next step, the glass lid 2 is placed onto the structure consisting of the connecting unit and the reflector 3. The glass lid 2 may also incorporate a profiled lense which is not shown in the drawing. The pre-assembly is then evacuated and filled with gas comprising a halogen and a rare gas. In this state the sealant 7 is then applied and hardened. Afterwards, the lamp 1 is ready for use.

Instead of using the sealant 7 as a connecting means between the reflector 3 and the lid 2 (FIG. 1), a direct melting of both parts can also be used as a sealant and connecting means between these two parts as is shown in FIG. 3. This kind of connection and sealing is especially suitable for high performance lamps since high temperatures are reached which transgress the usual temperature resistance of common sealant materials. The latter can be used up to a temperature of 220° C. If the sealing section is warmed higher than this value the embodiment shown in FIG. 3 is preferred in which the two glass parts are molted together.

The supply wires 4 may pass through the connection area without previous treatment. The unit shown in FIG. 2 is placed over the rim of the reflector 3'. After the evacuation and the filling with a halogen and a rare gas, the faces to be welded together by melting are warmed such that the supply wires 4 sink into the reflector rim and/or the glass lid. A gas-tight, complete welding of the two parts is thus achieved. If the materials for the glass parts and the supply wires 4 are correctly chosen not even quartz glass is necessary in order to obtain a troublefree passage of the supply wires 4 into the interior of the lamp 1.

Additionally, as shown in FIG. 1, the cross section of the supply wires at the connection area can be reduced or weakened so that, when the sealing material is not elastic, the supply wire suffers a plastic deformation during temperature variations and the heat expansions going with it.

In connection with FIGS. 4, 5 and 6 it is shown in which way a lamp 1 according to the invention can be inserted into a frame 11 made of plastic or tin and in which way the whole unit can be installed in a chip board 10 of, for instance, 19 mm thickness.

In the embodiments shown in the FIGS. 1 to 6, the glass lid 2 carries a thickened rim 9 which either has a circumferencial protrusion 29 (FIGS. 1 and 3) or a circumferencial groove 30 (FIGS. 4 to 6) with the aid of which the fixing of the lamp 1 within the frame 11 or in a different light frame (not shown) is carried out. The rim 9 serves to protect the lamp 1 from breakage, little cracks or splitting-offs are generally unimportant and negligible.

There is an automatic contacting, in the embodiment according to FIG. 4, between the supply wires 4 and two contact tongues 25 which are arranged one beside the other in the frame 11. With lamp 1 inserted in frame 11, contact tongues 25 elastically meet the supply wires 4. A recess 16 in the rim 9 which cooperates with a corresponding protrusion (not shown) in the frame 11 ensures the orientation of the lamp 1 such that the supply wires 4 meet the contact tongues 25. It is clearly shown that there is sufficient room for a cable 19 within the thickness of the chip board 10 to supply electric power to the lamp 1.

In the embodiment shown in FIG. 5, the supply wires 4 are slightly bent so that they run substantially parallel to the surface of the reflector 3 (FIG. 1). In this way it is possible to push a plug 31 or a standard socket over the free ends of the supply wires 4 without leaving the silhouette of the chip board 10 which is also shown in this FIG. 5. Also in this embodiment the cable 19 connected to the plug 31 can still be placed within the height of the chip board 10. Otherwise, it is clearly shown that the frame 11 is mounted into an opening of the chip board 10 with the aid of hooks 39 which carry at their inner side a total of three snap protrusions 13 which are received in the groove 30 of the rim 9. In this way the lamp 1 is fixed and positioned.

The embodiment shown in FIG. 6 is provided for an electrical connection with a current rail 14. The supply wires 4 are so formed that they extend perpendicular to the middle plane of the lamp 1. They cooperate with contact strips 15 within the current rail 14. After the snapping-in of the whole lamp 1 into the snap protrusions 13 (not shown in FIG. 6, but compare to FIG. 5) to obtain the correct orientation as to the current rail 14, the installation is completed, i.e. the lamp 1 is not only fixed and positioned but also electrically connected with the current rail 14. The bedding-in of the current rail 14 into the chip board 10 causes no problems since a corresponding channel can be cut into the chip board from the backside.

In the shown embodiments, the glass lid 2 carries a nipple 18 which is used for handling the lamp during the mounting and demounting into the frame 11 or the like. In a modified version the nipple 18 may be removable so that it is, during use, hooked under the rim 9, under the protrusion 29, or into the groove 30 until the removal of the lamp 1 out of a frame 11 or the like is necessary.

The embodiments according to FIGS. 4, 5 and 6 show, as an example, the electrical connection to the supply wires 4 of the lamp 1 with the aid of a plug 16, a current rail 14 and automatically according to FIG. 4. Of course, other modifications can be made, not only to the electrical connection but to all other features of the lamp 1. A colored reflective gloss film may be applied to the reflector 3, a colored lens in the glass lid 2 may be used and/or a colored deposit may be placed onto the lens. Of course, colored glass can also be used and the rim 9 may be used for decoration by coating, depositing or the like, such as incorporating a certain pattern or structure. The reflector may be a cold light reflector, i.e. may be provided with a coating which is permeable for heat radiation but reflective for light radiation. This kind of lamp 1 is used where the heat radiation is unwanted, for instance when valuable art objects are illuminated.

Alternatively, the reflector 3 can also be a stepped reflector if a big light emitting surface is requested.

What is claimed is:

1. A lamp for use in an enclosed room, said lamp comprising:

a reflector having a peripheral rim, an interior reflector surface and an exterior reflector surface;

a glass lid having a peripheral flange extending over said reflector peripheral rim;

a filament supported by at least two supply leads;

said reflector peripheral rim and said glass lid peripheral flange being sealingly interconnected by a sealant along a fixing seam to thereby define an interior region of said lamp;

each said supply lead being guided from a position adjacent said reflector exterior surface through a peripheral connection point between said reflector rim and said glass lid flange into said lamp interior region; and wherein said two supply leads are positioned parallel and juxtaposed to one another and secured in a clip-like formation over said reflector rim, said clip-like formation including said parallel, juxtaposed leads being held by an electrically insulated connecting element adjacent said reflector exterior surface, extending over said reflector rim, and along said reflector interior surface.

2. The lamp according to claim 1 wherein each said supply lead has a reduced cross-sectional area where said supply lead passes through the peripheral connection point between said reflector rim and said glass lid flange.

3. The lamp according to claim 1 wherein said glass lid flange extends downwards over said reflector rim and includes a circumferential groove.

4. The lamp according to claim 3 wherein said glass lid further includes a nipple protruding outwards from a front side of said glass lid.

5. The lamp according to claim 1 wherein said glass lid flange extends downwards over said reflector rim and includes a circumferential protrusion for use in securing said lamp within a holder.

6. The lamp according to claim 5 wherein said glass lid further includes a nipple protruding outwards from a front side of said glass lid.

7. The lamp according to claim 1 wherein said reflector is a cold light reflector.

8. The lamp according to claim 1 wherein said reflector exterior surface includes a mirrored surface.

9. The lamp according to claim 8 wherein said reflector further includes a protective layer disposed over said mirrored surface.

10. The lamp according to claim 1 wherein said reflector is a stepped reflector.

11. The lamp according to claim 1 wherein said supply leads run parallel to a middle plane of said glass lid and are spaced relative to each other such that said supply leads are positioned for making electrical contact with contact tongues of a frame when said lamp is received therein.

12. The lamp according to claim 1 wherein said supply leads run substantially perpendicular to a middle plane of said glass lid and are spaced relative to each other such that said supply leads are positioned for making electrical contact with contact tongues of a common socket for halogen bulbs.

13. The lamp according to claim 1 wherein said glass lid further includes a nipple protruding outwards from a front side of said glass lid.

14. The lamp according to claim 1 wherein said reflector is made from glass and said peripheral connection point is a fused seal.

15. The lamp according to claim 1 wherein said peripheral connection point is formed from a sealing material.

16. The lamp according to claim 1 wherein said sealant connecting said reflector peripheral rim and said glass lid peripheral flange includes direct melting of said glass lid and said reflector to one another.

* * * * *